United States Patent [19]

Sawai et al.

[11] Patent Number: 4,671,600

[45] Date of Patent: Jun. 9, 1987

[54] POWER FEEDER FOR ELECTROMAGNETIC VALVE

[75] Inventors: Hideaki Sawai; Hideharu Sato, both of Soka, Japan

[73] Assignee: Shoketsu Kinzoku Kogyo Kabushiki Kaisha, Tokyo, Japan

[21] Appl. No.: 825,978

[22] Filed: Feb. 4, 1986

[30] Foreign Application Priority Data

Mar. 23, 1985 [JP] Japan ..... 60-42242[U]
Mar. 23, 1985 [JP] Japan ..... 60-42243[U]

[51] Int. Cl.[4] ..... H01R 13/50

[52] U.S. Cl. ..... 439/221; 439/224; 439/355; 439/651

[58] Field of Search ..... 339/154 R, 154 A, 156 R

[56] References Cited

U.S. PATENT DOCUMENTS 4,430,983 2/1984 Hagen ..... 339/154 R

*Primary Examiner*—Gil Weidenfeld

*Assistant Examiner*—Paula A. Austin

*Attorney, Agent, or Firm*—Oblon, Fisher, Spivak, McClelland & Maier

[57] ABSTRACT

Described herein is a power feeder for electromagnetic valves, comprising: a solenoid casing having male terminals for an exciting coil in a connecting section on one side wall thereof; a terminal plate having female terminals to be connected to said male terminals and relay terminals consisting of a pair of L-shaped pins electrically connected to the female terminals; and a cover attached to the connecting section in such a manner as to enclose the terminal plate on the connecting section and provided with at least one connector socket at a position opposing one arms of the L-shaped relay terminal pins. This power feeder arrangement permits to couple a connector to the terminal selectively from one of two perpendicularly intersecting directions and to universalize the male terminals of the solenoid as well as the terminal plate to be connected thereto.

5 Claims, 5 Drawing Figures

POWER FEEDER FOR ELECTROMAGNETIC VALVE

BACKGROUND OF THE INVENTION

1. Field of the Invention

This invention relates to a power feeder for electromagnetic valves

2. Description of the Prior Art

As disclosed, for example, in Japanese Laid-Open Utility Model Application No 59-103973, the conventional power feeder for electromagnetic valve is arranged to couple a connector directly with a male terminal of a solenoid. In many cases, however, the direction of taking out feeder lines is restricted when mounting solenoid valves on various apparatus, so that the above-mentioned coupling construction consisting of a male terminal of a solenoid and a connector needs to provide solenoids of various types in terms of the direction of connection since the shape of the male terminal is varied to cope with differences in the direction of coupling a connector with a solenoid male terminal. Due to the difficulty of universalizing the coupling construction, the manufacture of solenoids has been low in efficiency and high in cost.

SUMMARY OF THE INVENTION

With foregoing situations in view, the present invention has as its primary object the provision of a power feeder for electromagnetic valves, employing a pair of L-shaped relay pins to permit to electrically couple a connector with the male terminal of a solenoid from one of two different directions irrespective of the direction of projection of the solenoid male terminal, thereby enabling to universalize the solenoids for enhancement of production efficiency and reduction of cost.

It is another object of the present invention to provide a power feeder for electromagnetic valves, employing a pair of L-shaped pins as a relay member for electrically coupling a connector with the male terminal of a solenoid, the pins being projected at right angles with each other for electrically coupling a connector, thereby permitting to alter the connector coupling direction in an extremely simplified manner.

It is a further object of the present invention to provide a power feeder for electromagnetic valves having a simplified construction for mounting the L-shaped pins and electrically connecting the L-shaped pins to a solenoid male terminal, by fixedly mounting the L-shaped pins into a terminal plate to be attached to the male terminal of the solenoid.

In order to achieve the above-mentioned objectives, the present invention provides a power feeder for electro-magnetic valves, comprising: a valve driving solenoid having a male terminal of an exciting coil at a connecting section on a side wall thereof; a terminal plate provided with a female terminal to be coupled with the male terminal and a relay terminal consisting of a pair of L-shaped pins electrically connected to the female terminal; and a cover attached to the connecting portion in such a manner as to enclose the terminal plate and provided with at least one connector socket in a position opposing one connecting arms of the L-shaped relay terminal pins.

The power feeder for electromagnetic valves, with the above-described construction according to the invention, has the female terminal on the terminal plate coupled with the male terminal on the connecting section of the solenoid casing, the relay terminals consisting of a pair of L-shaped pins electrically connected to said female terminals, and a connector connected to the one connecting arms of the L-shaped relay terminal pins. Therefore, the connector can be connected to the solenoid from the upper or lateral side thereof, so that it is no need to provide solenoids of various types in terms of the direction of connection. As the result, it is performed to increase production efficiency and reduce cost of the electromagnetic valves.

Further, since the connecting portions between the male and female terminals, the female and relay terminals, and the relay terminal and the connector are wholly enclosed by the cover, the power feeder for electromagnetic valve of the invention is safety in operation and can prevent miss-operation of the solenoid.

The above and other objects, features and advantages of the invention will become apparent from the following description and the appended claims, taken in conjunction with the accompanying drawings. Needless to say, the partistructures shown in the drawings are of preferred embodiments of the invention and should not be construed as limitative of the invention.

DESCRIPTION OF PREFERRED EMBODIMENTS

Figure 1:
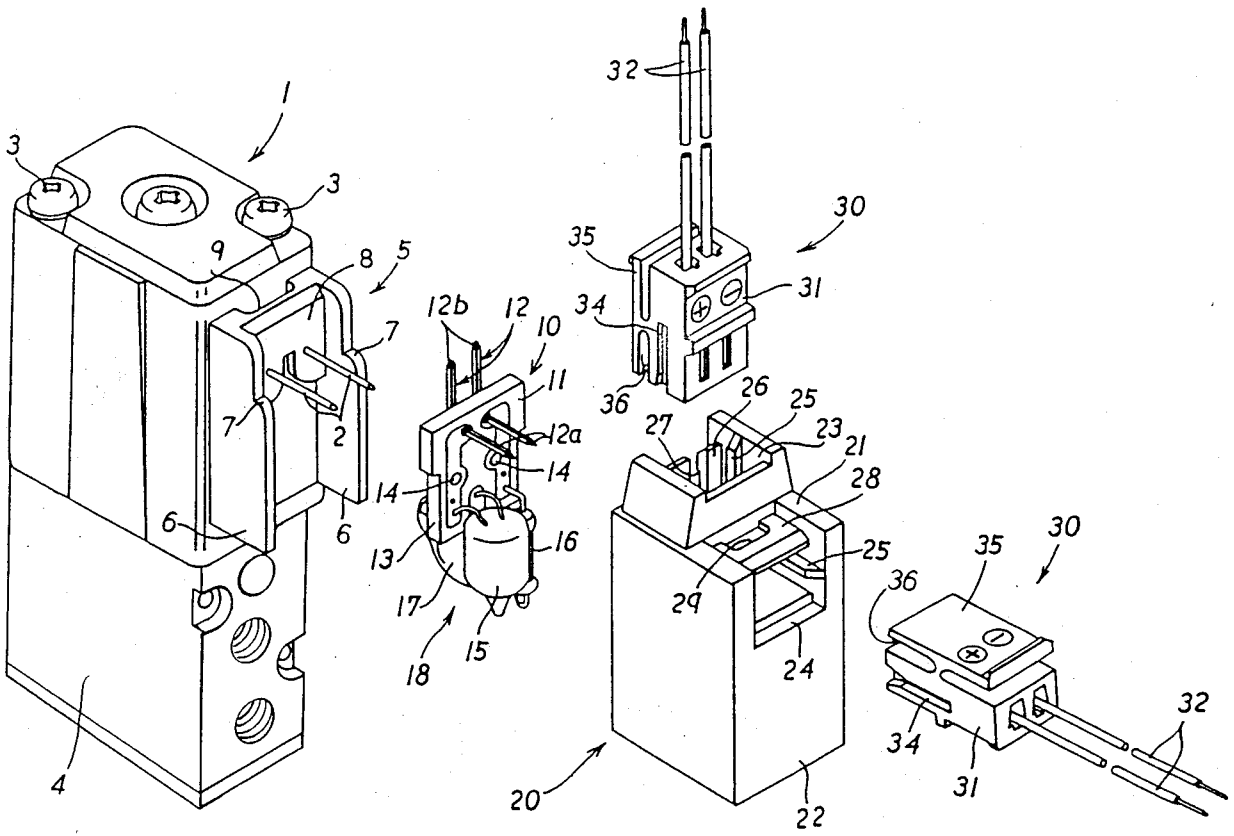
FIG. 1 is an exoloded perspective view of an embodiment of the invention.

Referring to FIG. 1, the solenoid 1 is formed by anchoring an exciting coil, not shown, and its male terminals 2 integrally in a casing of an insulating synthetic resin material at the time of molding, and thereafter being attached to a valve casing 4 by screws 3 to form an electromagnetic valve.

The solenoid 1 is provided with a connecting section 5 on one side wall thereof. This connecting section 5 is U-shaped in section, and provided with wing-like side walls 6 each with a stepped portion 7 in an upper portion thereof. A front wall portion 8 which interconnects the side walls 6 is provided with a groove 9 on its top surface. The male terminals 2 are protruded from the just-mentioned front wall section 8.

A terminal plate 10 to be connected to the solenoid casing 1 is provided with relay terminals 12 in the form of a pair of L-shaped pins 12 of a square shape in section, which are fixed in a broader portion of a base plate 11 by inserting horizontal pin portions or arms **12*a* into the base plate 11 in a direction perpendicular to the base plate with vertical pin portions or arms 12*b* projected above the top edge of the base plate 11. These interconnecting terminals 12 are not rotatable relative to the base plate 11 since they are formed in a square shape in section, and therefore the vertical pins 12*b* can be easily fixed in position on the base plate 11**.

Provided on a narrow portion 13 of the base plate 11 are female terminals 14 for insertion of the male terminals of the solenoid, mounting thereon electric and electronic parts 18 which are necessary for conduction of the solenoid, including a conduction indicator 15, a resistor 16, a counter emf inhibitor 17 and the like. These electric and electronic parts are all electrically connected to the relay terminals 12. In this manner, the power feeder section of an electro-magnetic valve can be minimised since there is no need for providing a special support structure for the electric and electronic parts necessary for conduction of the solenoid, on the base plate 11 which serves to mount and interconnect the relay terminals and the female terminals. In this case, it is desirable to provide a printed wiring on the base plate 11 for the electric connection.

The cover 20 which houses the connecting section 5 with the terminal plate 10 is open on the side which faces the connecting section 5 and, though omitted from illustration, is fixable to the connecting section 5 by a stopper claw which is provided at the inner edge (open side) of its top wall 21 for engagement with the groove 9 on the connecting section 5. The cover 20 is provided with connector sockets 23 and 24 in its top and front walls 21 and 22, respectively. These connector sockets 23 and 24 are provided with connector guide ribs 25 on the opposite side walls thereof, and formed with grooves 27 and 29 in stopper walls 26 and 28 which are provided between the receptacle side walls.

A connector 30 is disengageably fitted in one of the connector sockets 23 and 24. Power feeder lines 32 and connected to the female terminals on the body 31 of the connector 30. The connector body 31 is provided with grooves 34 in the opposite side walls, which are engageable with the ribs 25 in the cover when the connector 30 is inserted into the connector socket 23 or 24. Further, the connector 30 is provided with a hook 35 of a resilient synthetic resin material which is rockable like a see-saw on the connector body 31. A click 36 which is provided at the fore end of the hook 35 is stopped in the groove 27 or 29 of the cover 20 when the connector 30 is inserted into the cover 20.

In the above-described embodiment, the terminal plate 10 is attached to the connecting section 5 by fitting the female terminals 14 on the male terminals 2 of the solenoid, positioning the lower side of the broad portion of the base plate 11 on the stepped portions 7. The electric connection of the female terminals 14 and male terminals 2 are not limited to the above-mentioned press-fit engagement.

The connecting section 5 with the terminal plate 10 connected thereto is housed in the cover 20 by stopping the click of the cover 20 in the groove 9 on the connecting section 5. The connector 30 is put into either the connector socket 23 or 24 in the cover 20, inserting the vertical **12*b* or horizontal pins 12*a* into the female terminals to electrically connect it to the solenoid 1. In this manner, the cover 20 which is provided with a couple of connector sockets correspondingly to the respective pins to the relay terminals, so that it can be universalized irrespective of the coupling direction of the connector to realize improvements in production efficiency and cost of electromagnetic valves. In case the cover 20** is provided with a couple of connector sockets as in the particular embodiment shown, the free socket which is not occupied by the connector may be closed with a lid or other suitable means.

Figure 2:
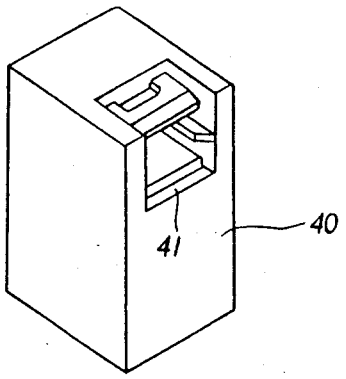
FIGS. 2 and 3 are perspective views of covers of different constructions for the embodiment of FIG. 1.
Figure 3:
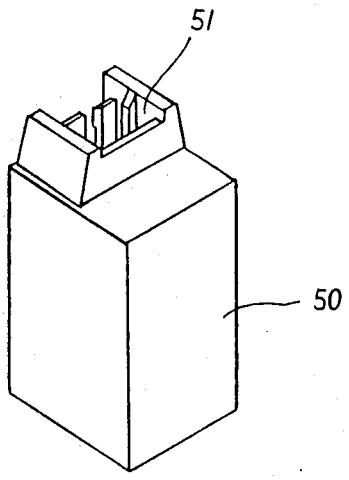

The cover to be used in the present invention is not limited to the above-described construction which contains a couple of connector sockets, and may be provided with only one of the sockets 23 and 24. In such a case, a cover 40 with a horizontal socket 41 or a cover 50 with a vertical socket 51, as shown in FIGS. 2 or 3, is fitted on the connecting section 5.

In a case where the cover 40 or 50 is used, it becomes necessary to replace the cover to change the coupling direction of the connector relative to the solenoid. However, the covers 40 and 50 has a merit that the pins which are not in service are kept from contaminations with dust, oil or the like.

If there is no possibility of changing the connecting direction of feeder lines later, the horizontal pins **12*a* or vertical pins 12*b* whichever are unnecessary may be cut off from the L-shaped pins of the relay terminals 12 to minimise the cover 40 or 50**.

Figure 4:
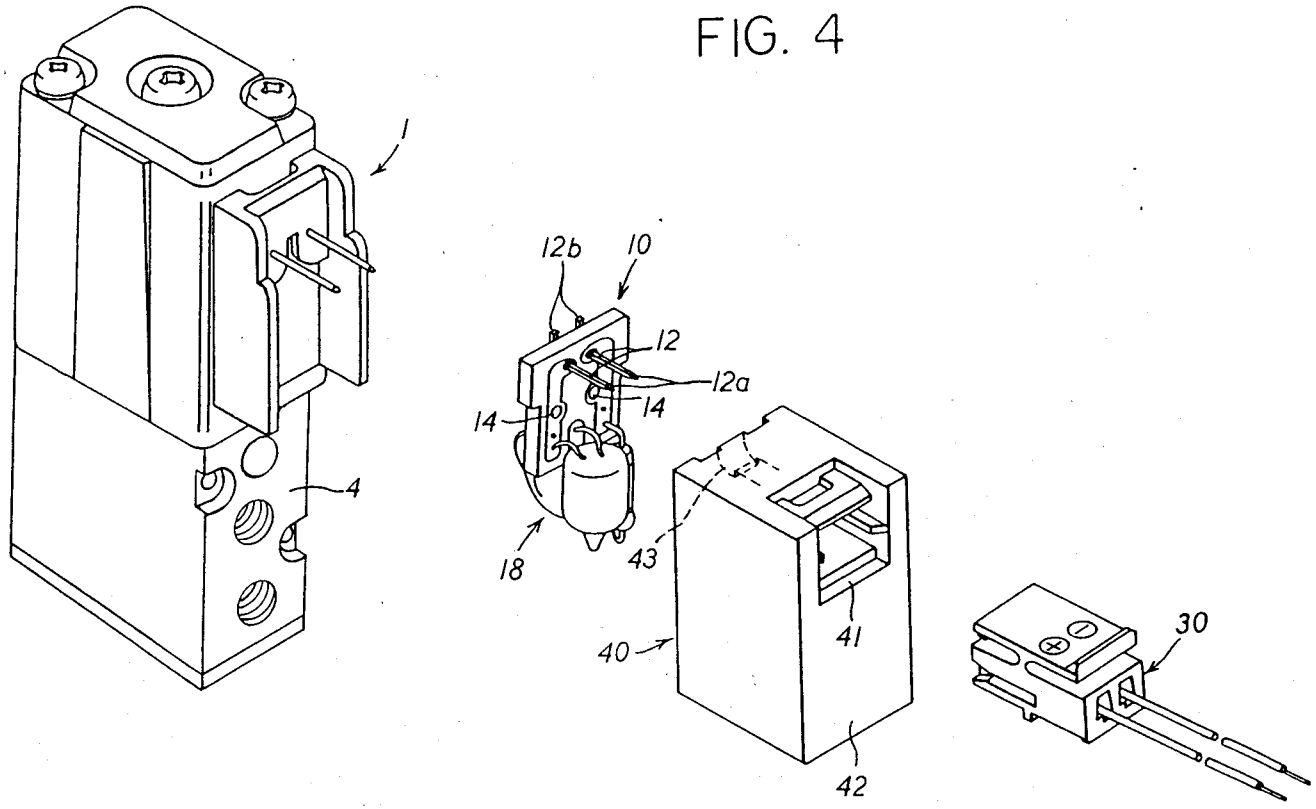
FIG. 4 is an exploded perspective view of another embodiment, showing the manner of connecting a power supply connector from the front side of a terminal plate.
Figure 5:
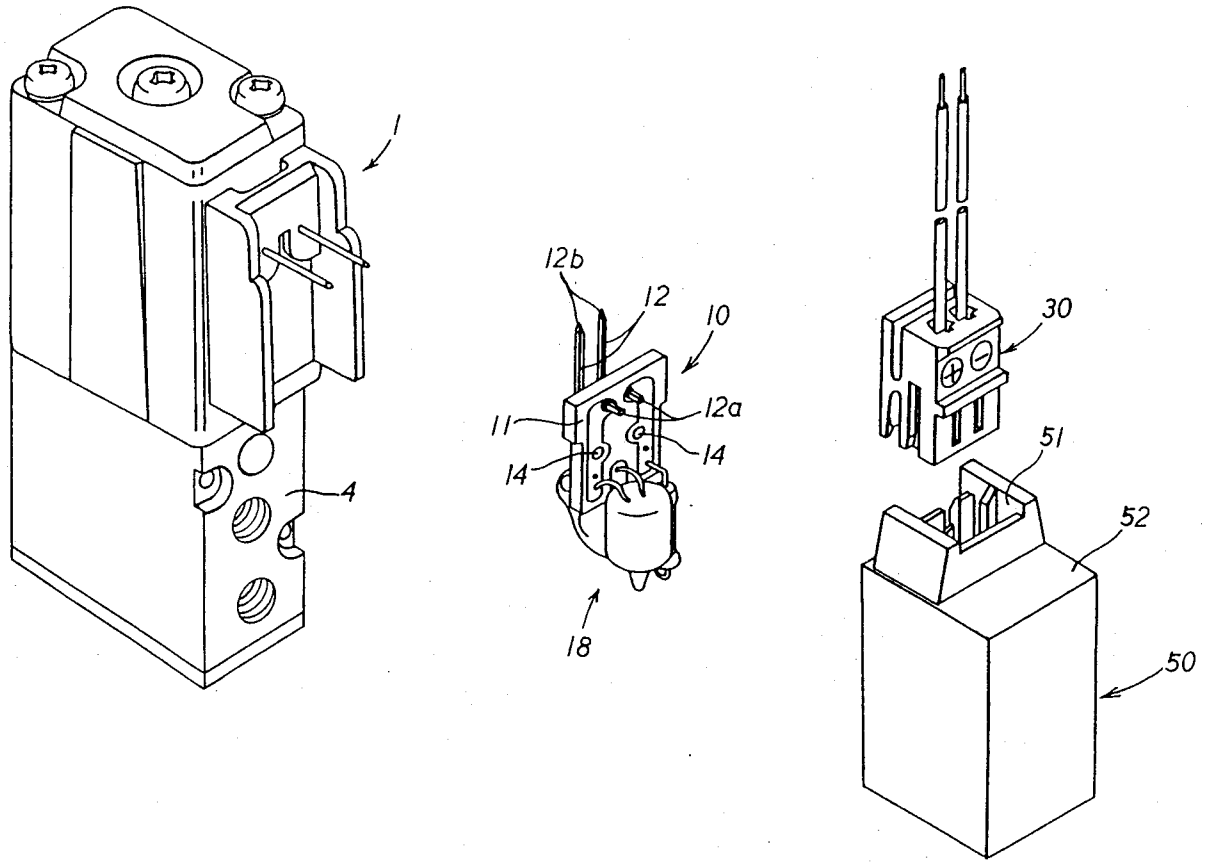
FIG. 5 is an exploded perspective view showing the manner of connecting the power supply connector from above the terminal plate.

Illustrated in FIGS. 4 and 5 are examples in which unnecessary pins are cut off prior to use.

In the embodiment shown in FIG. 4, power is supplied through a connector 30 which is inserted in a connector socket 41 formed in a front wall 42 of the cover 40 and a terminal plate 10 which has the vertical pins **12*b* of the relay terminals cut off at the base ends thereof. In this case, the cover can be formed in a smaller size as compared with the cover 50 of FIG. 3, since there are no projecting portions on the top side of the cover. In this figure, the reference numeral 43 denotes a claw for connecting the cover 40 to the solenoid 1**.

FIG. 5 illustrates another embodiment, in which power is supplied through a connector 30 which is inserted in a connector socket 51 opened in the top wall 52 of the cover 50, and the horizontal pins **12*a* of the L-shaped relay pihs 12 are cut off. In this case, the cover 40 can be formed in a thin as compared with the cover 40 of FIG. 2**.

What is claimed is:

1. A power feeder for electromagnetic valves, comprising:

a solenoid casing having male terminals at a connecting section on a side wall thereof;

a terminal plate provided with female terminals to be connected to said male terminals and relay terminals constituted by a pair of L-shaped pins electrically connected to said female terminals; and a cover attached to said connecting section of said solenoid casing in such a manner as to enclose the connecting section and provided with at least a connector socket at a position opposing one of said relay terminal pins.

2. The power feeder for electromagnetic valves of claim 1, wherein said terminal plate includes a base plate, L-shaped relay terminal pins mounted through said base plate and having arms thereof extended forward and upward of said base plate, electric and electronic parts mounted on said base plate, and a circuit electrically connecting said electric and electronic parts to said relay terminals.

3. The power feeder for electromagnetic valve of calim 1 or 2, wherein said cover is provided with connector sockets at positions opposing both of said relay terminal pins, selectively inserting a connector of a common construction in one of said connector sockets.

4. The power feeder for electromagnetic valve of claim 1 or 2, wherein said cover is provided with a connector socket at a position opposing one of said relay terminal pins and closed at a position opposing the other one of said relay terminal pins.

5. The power feeder for electromagnetic valve of claim 1 or 2, wherein said cover is provided with a single connector socket, and said L-shaped pins of said relay terminals each have one arm thereof eut off to leave the other pin arm for connecting only at a position opposing said single connector socket.

* * * * *